United States Patent [19]

Fournier

[11] 4,039,132

[45] Aug. 2, 1977

[54] PLANT SUPPORT STRUCTURE

[76] Inventor: Peter R. Fournier, 29 N. Gore (Rear), St. Louis, Mo. 63119

[21] Appl. No.: 646,494

[22] Filed: Jan. 5, 1976

[51] Int. Cl.[2] ..... A47G 23/02

[52] U.S. Cl. ..... 248/150; 46/28; 211/189; 248/163

[58] Field of Search ..... D6/113, 137, 181, 182, D6/183; D35/3 A, 3 B, 3 C; 46/20, 27, 28; 47/34, 39, 40, 44, 45; 108/153, 155–157; 211/85, 186, 189; 248/460, 127, 146, 150–153, 163, 165, 174

[56] References Cited

U.S. PATENT DOCUMENTS

| | | | |
|---|---|---|---|
| 366,051 | 7/1887 | Weatherley | 211/186 X |
| 1,393,679 | 10/1921 | Forster | 108/153 X |
| 1,897,905 | 2/1933 | Johnson | 248/163 X |
| 1,988,598 | 1/1935 | Kleemeyer | 47/39 UX |
| 3,797,671 | 3/1974 | Sebilleau et al. | 211/188 X |
| 3,834,549 | 9/1974 | Burg et al. | 211/189 |
| 3,887,288 | 6/1975 | Glaser | 211/189 X |
| D. 237,029 | 10/1975 | Gempel | D35/3 C X |
| D. 239,149 | 3/1976 | Hussey | D35/3 C X |

FOREIGN PATENT DOCUMENTS

| | | | |
|---|---|---|---|
| 8,722 | 8/1927 | Australia | 47/39 |
| 2,050,599 | 4/1972 | Germany | 46/28 |
| 890,764 | 3/1962 | United Kingdom | 108/156 |
| 1,247,937 | 9/1971 | United Kingdom | 108/153 |
| 144,765 | 6/1920 | United Kingdom | 46/28 |

*Primary Examiner*—Lawrence J. Staab
*Attorney, Agent, or Firm*—John M. Howell

[57] ABSTRACT

A plant support having interlocking horizontal and vertical members, some of the horizontal members providing frame assemblies which interlock with the vertical members by means of recesses or notches. An intermediate frame structure is located closer to one end of the support than the other, and in one embodiment a platform assembly comprising cross members engages any one of the frame assemblies to provide a variety of levels at which to support a flower pot or the like.

7 Claims, 18 Drawing Figures

PLANT SUPPORT STRUCTURE

SUMMARY OF THE INVENTION

This invention relates to a support structure and particularly such a structure for supporting a plant or the like.

The structure generally comprises elongated, rigid, interlocking members, including vertical members which define the frame assemblies at the ends and on intermediate location of the vertical members. The horizontal members of the frame assemblies interlock with each other and also interlock with the vertical members such that the support structure is held together by these interlocking members without the need for other fastening means, such as nails, screws, glue, or the like.

The intermediate frame assembly is located nearer one end than the other, and in one embodiment there is provided a platform assembly comprising cross members that can be made to engage any one of the frame assemblies to provide a variety of levels at which a flower pot or the like can rest. Additonally, the members which comprise the frame assemblies are identical to minimize the different types of members required, thereby minimizing manufacturing costs.

The support .can be sold in knock-down form for assembly by the purchaser by means of only the interlocking members provided.

Thus, it is an object of this invention to provide a support struture for a plant or the like which is made from substantially rigid elongated memers which interlock to hold the structure together, wherein the number of different types of members required in the structure is minimized for ease in manufacture and assembly, wherein a variety of levels are provided at which to support a flower pot or the like, and where the structure can be sold in knock-down form and easily assembled by the purchaser by means of the interlocking members provided and without the need for other fastening means.

These and other objects of the invention are apparent from the drawings and detailed description to follow.

DETAILED DESCRIPTION OF A PREFERRED EMBODIMENT

Figures 1, 9, 11, 12, 13, 14, 15, 16:
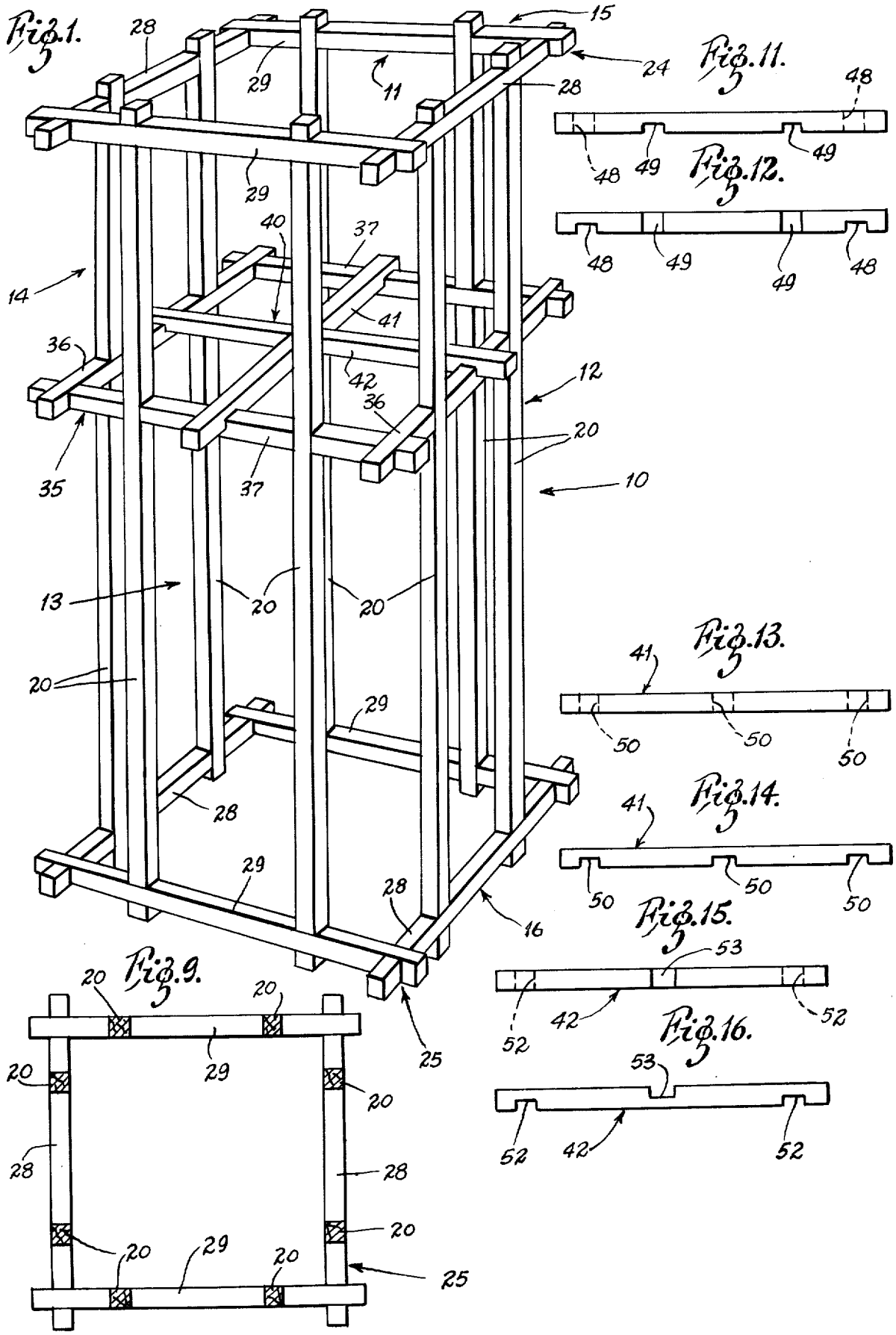
FIG. 1 is a perspective view showing a plant support of this invention.
FIG. 9 is a view in section taken generally along the line 9—9 of FIG. 5.
FIG. 11 is a top plan view of a horizontal side member used in the plant support of this invention.
FIG. 12 is a side elevation view of the side member of FIG. 11.
FIG. 13 is a top plan view of a horizontal platform member used in the plant support of this invention.
FIG. 14 is a side elevational view of the platform member of FIG. 13.
FIG. 15 is a top plan view of another horizontal platform member usded in the plant support of this invention.
FIG. 16 is a side elevation view of the platform member of FIG. 15.
Figure 2:
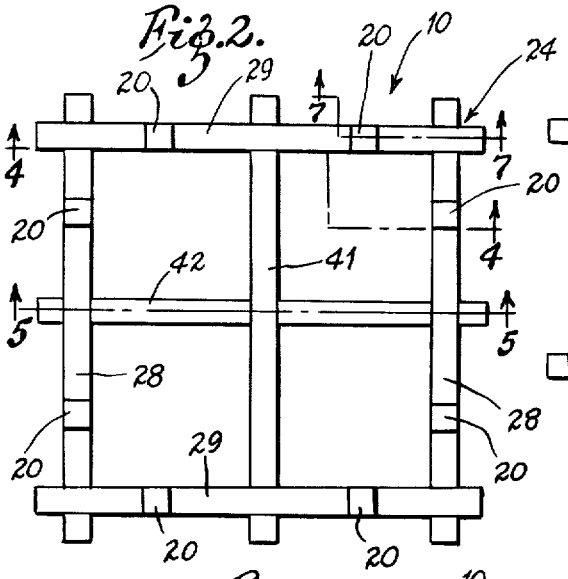
FIG. 2 is a top plan view of the plant support of FIG. 1.
Figure 4:
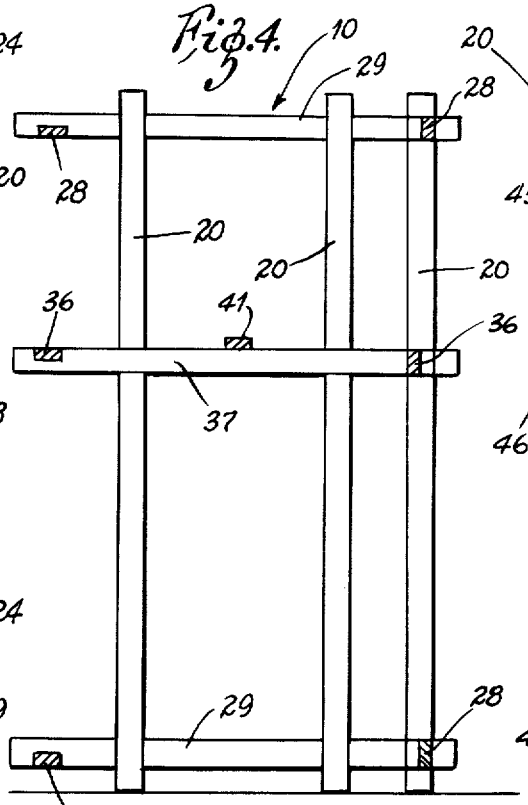
FIG. 4 is a view in section taken generally along the line 4—4 of FIG. 2.

Referring to he drawing, there is shown a plant support structure 10 of this invention having sides 11, 12, 13 and 14, and ends 15 and 16. The end 15 is shown at the top and the end 16 at the bottom, but as will be explained, the entire support 10 can be inverted so that the end 15 is at the bottom and the top end 16 at the top.

Each of the sides 11 through 14 is identical and is defined as having vertical side members 20 which extend the entire length of the support between the ends 15 and 16. As viewed in FIG. 1, the upper ends of the members 20 are interlocked with a horizontal frame assembly 24, and the bottom ends of the members 20 are interlocked with a horizontal frame assembly 25. The frame assemblies 24 and 25 are identical, and each includes interlocking horizontal members 28 and 29 which are identical, the members 28 being inverted with respect to the members 29.

A third horizontal frame assembly 35 interlocks with the vertical side member 20 at a location between the frame assemblies 24 and 25. In a preferred embodiment, the frame assembly 35 is located closer to one of the frame assemblies 24 or 25 than the other for reasons to be explained. The frame assembly 35 has horizontal side members 36 and 37 which are identical, the members 37 being inverted relative to the members 36. The members 36 and 37 are also identical to the members 28 and 29, but oriented differently in the assembly.

Figure 3:
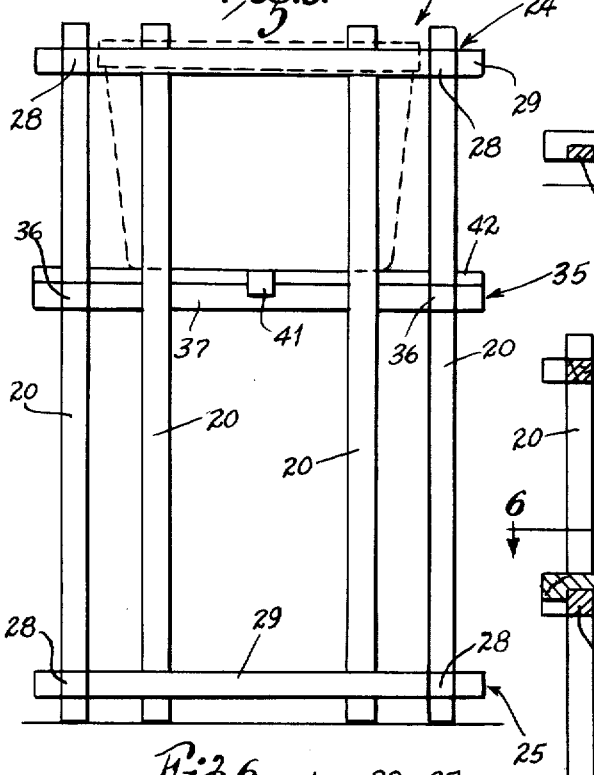
FIG. 3 is a side elevation view of the plant support of FIG. 1.
Figure 5:
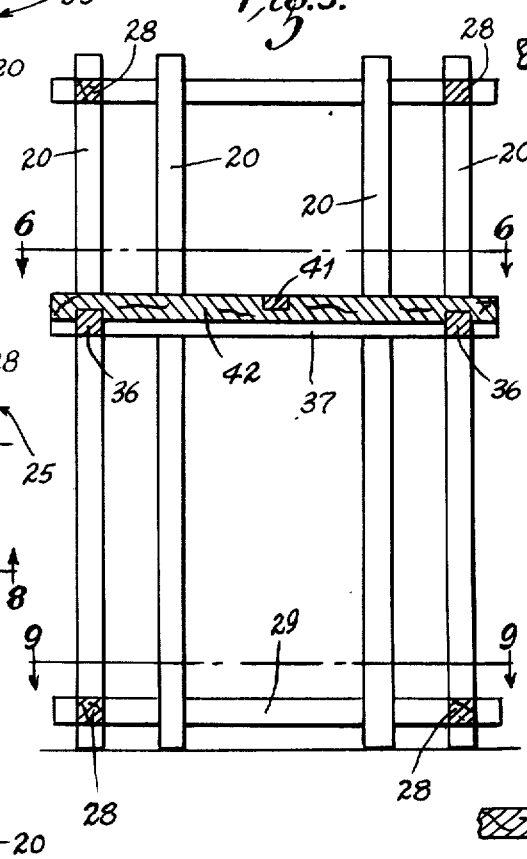
FIG. 5 is a view in section taken generally along the line 5—5 of FIG. 2.
Figure 7:
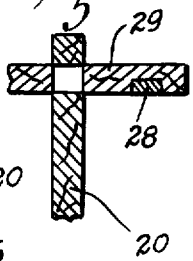
FIG. 7 is a view in section taken generally along the line 7—7 of FIG. 2.
Figure 6:
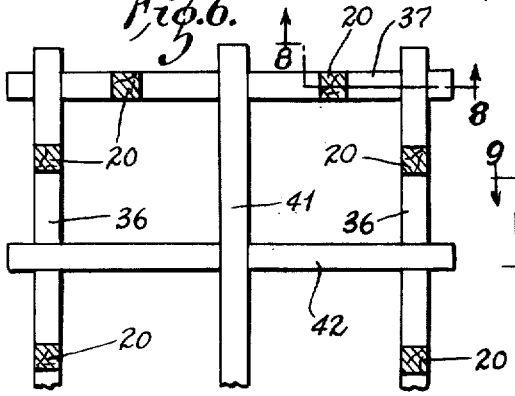
FIG. 6 is a view in section taken generally along the line 6—6 of FIG. 5.
Figure 8:
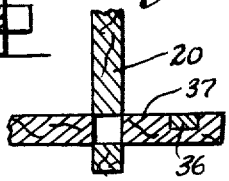
FIG. 8 is a view in section taken generally along the line 8—8 of FIG. 6.

A platform 40 on which may be placed a flower pot or the like, as shown by the dashed lines in FIG. 3, comprises horizontal cross members 41 and 42 which are shown to engage the frame assembly 35. As will be hereinafter explained, the platform 40 can also be made to engage either of the frame assemblies 24 or 25, and can rest on either side of the assemblies 24, 25, and 35 depending on which end of the support is placed at the bottom and further depending on the desired height of the flower pot or the like.

Having described the structure generally, each of its members will now be described in more detail.

Figure 10:
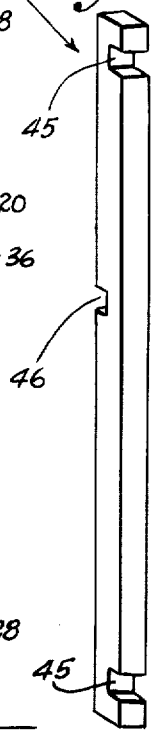
FIG. 10 is a perspective view of a vertical side member used in the plant support of FIG. 1.

In FIG. 10 there is shown a vertical side member 20 having notches or recesses 45 at the ends facing in one direction and a notch 46 therebetween facing the opposite direction.

In FIGS. 11 and 12 there is shown the horizontal members 28 and 29, 36 and 37 of the frame assemblies 24, 25 and 35 which are identical, but are oriented differently in the support 10 to provide interlocking structure without the need for nails, screws, glue, or the like to hold it together. Thus, as shown in FIGS. 11 and 12, each of these horizontal members has notches or recesses 48 at its ends facing the same direction and notches 49 therebetween facing in a direction ninety degrees from the notches 48. With reference to FIG. 1 it can be seen that the member 29 is inverted relative to the member 28 with the notches 48 of the members 28 interlocking with the notches 48 of the members 29 to form the frame assemblies 24 and 25. The members 36 are inverted and turned end-for-end relative to the member 28 with the member 37 being inverted relative to the member 36. The notches 48 of the members 36 interlock with the notches 48 of the members 37 to form the frame assembly 35. Thus, it will be seen that the notches 49 of the members 28 and 29 face inwardly while the notches 49 of the members 36 and 37 face outwardly.

The vertical members 20 are oriented with their notches 45 facing outwardly and notches 46 facing inwardly, such that the notches 45 interlock with the notches 49 of the members 28 and 29, and the notches 46 interlock with the notches 49 of members 36 and 37.

In FIGS. 13 and 14, there is shown the member 41 and in FIGS. 15 and 16, the member 42. The member 41 has notches 50 all facing the same direction, while the member 42 has notches 52 at its ends facing in one direction and a notch 53 therebetween facing in the opposite direction. The memer 41 overlies the member 42 with the notch 50 engaged with the notch 53 such that the notches 50 and 52 face downwardly and engage the horizontal frame members of any one of the frame assemblies 24, 25 or 35.

ASSEMBLY

From the foregoing it can readily be seen how the support 10 is assembled. While there are no doubt a number of ways to assemble the unit, one such way is to begin by assembling the frame assemblies 24 and 35 as shown. Next, the vertical members 20 are interlocked with the frame assemblies 24 and 35 as shown in FIG. 1, with the longest portions of the members 20 extending freely from the section 35. These free ends of the members 20 on three sides of the unit may then be readily interlocked with three of the horizontal members 28 and 29 of the frame assembly 25 which, in turn, may be readily interlocked as shown in FIG. 1. This leaves only one of the members of the frame assembly 25 to be put in place and thereby lock the entire unit together. This is easily accomplished by applying an inward force at the free ends of the remaining two vertical members 20 which have enough resilience to allow the final frame member to be forced into interlocking engagement with the adjacent frame members and the vertical members. Thus, the bending force on the last of the members 20 to be locked into place is applied only temporarily, that force being relieved at least in part once the final frame member is properly interlocked. The various notches heretofore identified preferably extend slightly less than half way through the various members so that a slight bending force remains after assembly to enhance the rigidity of plant support structure.

Once assembled, the unit may be made to rest on either the end 15 or 16, and the platform members 41 and 42 may be placed on any one of the frame assemblies to provide four different levels for a flower pot or the like.

Figure 17:
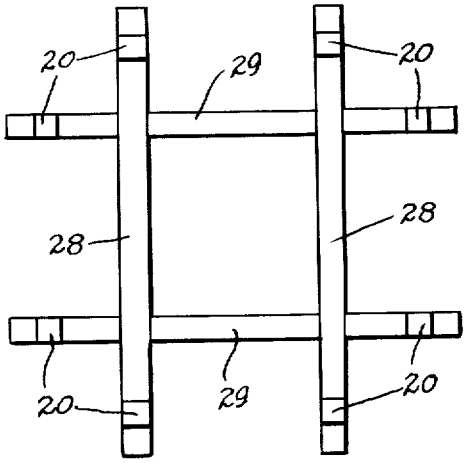
FIG. 17 is a side elevation of an alternate assembly of the plant support.
Figure 18:
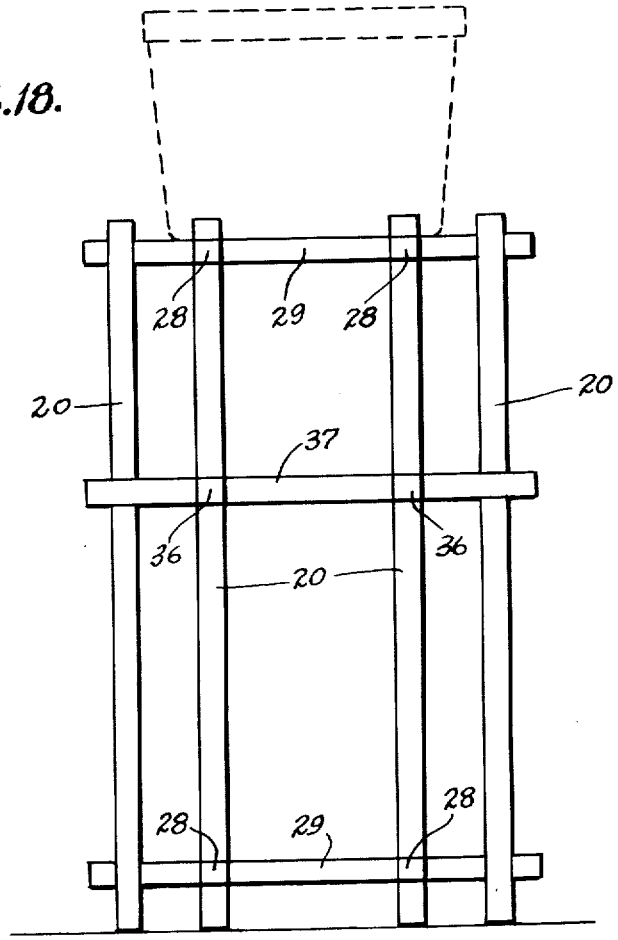
FIG. 18 is a top plan view of the assembly of FIG. 17.

FIGS. 17 and 18 show an alternate assembly of the same members 20, 28, 29, 36 and 37. It will be noted that the members 28 and 29 interlock at the notches 49 as do the members 36 and 37, rather than the notches 48 as with the first described assembly. Also, the members 20 interlock in notches 48 rather than the notches 49. Otherwise, the principles are the same. Platform members, such as the members 41 and 42 may be eliminated in this second assembly.

Thus, there has been described a novel plant support assembled with interlocking members without the need for other fastenings means, which is unique in structure and appearance, and which provides a variety of levels at which to support a flower pot or the like, and which otherwise fulfills the objects heretofore identified.

Various changes and modifications may be made in this invention, as will be readily apparent to those skilled in the art. Such changes and modifications are within the scope and teaching of this invention as defined by the claims appended hereto.

What is claimed is:

1. A support structure for a plant or the like comprising vertical members defining the sides of the structure, said vertical members being elongated and rigid and having at least three recesses therein spaced along their length, the recesses at opposite ends of each of said vertical members facing in a direction opposite to the recesses of said vertical member between those at its ends, a first set of horizontal members located near one end of said support, a second set of horizontal members located near the other end of said support, and a third set of horizontal members located between said first and second set, each set having horizontal members associated with each side of the support structure, and a horizontal member of each set having recesses therein which interlock with recesses in a horizontal member associated with an adjacent side, each vertical member interlocking with a horizontal member in each set, the recesses in said horizontal members in said first and second sets which interlock with said vertical members facing opposite to those of said third set, whereby said horizontal and vertical members are secured in interlocking engagement.

2. The support structure of claim 1 further comprising a platform means for supporting a flower pot or the like, and means supporting said platform means on said support structure.

3. The support structure of claim 2 wherein said platform further comprises horizontally disposed members that engage selected ones of said horizontal members.

4. The support structure of claim 2 further comprising means for attaching said platform means to any one of said sets of horizontal members.

5. The support structure of claim 1 wherein said third set of horizontal members is located closer to one end of said support structure than the other.

6. The support structure of claim 1 wherein the vertical members are each interchangeable with the other, and the horizontal members are each interchangeable with the other.

7. A support structure for a plant or the like comprising first, second, and third frame assemblies, each comprising interlocking, substantially rigid, elongated horizontal members, said first and second frame assemblies being located at opposite ends of the support structure, and said third frame assembly being located therebetween, vertical members defining the sides of the structure, the vertical members being elongated and substantially rigid and having recesses therein which interlock with recesses in the members of the frame assemblies, the recesses at opposite ends of the vertical members facing in a direction opposite to their recess therebetween, the horizontal members of each of the frame assemblies having recesses which interlock with those of the vertical members.

* * * * *